US008231261B2

(12) United States Patent
Gherardini et al.

(10) Patent No.: US 8,231,261 B2
(45) Date of Patent: Jul. 31, 2012

(54) LED MODULE AND INTERCONNECTION SYSTEM

(75) Inventors: Stephen Daniel Gherardini, Harrisburg, PA (US); Matthew Edward Mostoller, Hummelstown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 449 days.

(21) Appl. No.: 12/025,904

(22) Filed: Feb. 5, 2008

(65) Prior Publication Data

US 2009/0196034 A1 Aug. 6, 2009

(51) Int. Cl.
*H01R 33/00* (2006.01)

(52) U.S. Cl. ..... 362/647; 362/640; 362/645; 362/646; 362/651; 362/652; 362/655; 362/656; 362/657; 362/658; 362/659

(58) Field of Classification Search ..... 362/640–659, 362/227–249.19
See application file for complete search history.

(56) References Cited

U.S. PATENT DOCUMENTS

| | | | | |
|---|---|---|---|---|
| 4,266,695 | A | 5/1981 | Ruperez | |
| 5,213,519 | A * | 5/1993 | Dorfman | 362/123 |
| 6,558,021 | B2 | 5/2003 | Wu et al. | |
| 6,648,492 | B1 * | 11/2003 | Shih | 362/249.01 |
| 7,481,670 | B2 * | 1/2009 | Chen | 362/650 |
| 2005/0007780 | A1 * | 1/2005 | Feuerborn et al. | 362/257 |
| 2005/0221659 | A1 | 10/2005 | Mrakovich et al. | |
| 2006/0284199 | A1 | 12/2006 | Matheson | |

FOREIGN PATENT DOCUMENTS

| | | | |
|---|---|---|---|
| CH | 693 242 | A5 | 4/2003 |
| DE | 10 2006 018 668 | A1 | 10/2007 |
| WO | WO 2005/015077 | A1 | 2/2005 |

OTHER PUBLICATIONS

PCT International Search Report; International Application No. PCT/US2009/000585; International Filing Date Jan. 30, 2009.

* cited by examiner

*Primary Examiner* — William Carter

(57) ABSTRACT

A LED module and interconnection system is disclosed. The LED module includes a lens, a housing, and a printed circuit board PCB having at least on LED disposed within the housing. The housing includes a plurality of openings providing physical and electrical access to the PCB. The interconnection system includes at least one LED module and a cable assembly. The cable assembly is configured to provide electrical connectivity to the LED module through an opening in the LED module housing.

20 Claims, 6 Drawing Sheets

LED MODULE AND INTERCONNECTION SYSTEM

FIELD OF THE INVENTION

The present invention relates generally to the field of lighting systems. More specifically, the present invention relates to an LED module and interconnection system for assembling LED modules into an array. The invention utilizes a module design that is flexible in mounting method, electrical connection method, LED array arrangements, and optical designs.

BACKGROUND OF THE INVENTION

Advances in the development and improvements of the luminous flux of light emitting diodes (LEDs) have made these devices suitable for use in general illumination applications, including architectural, entertainment, and outdoor lighting. As such, LEDs are becoming increasingly competitive with light sources such as incandescent, fluorescent, and high-intensity discharge lamps.

LEDs offer a number of advantages and are generally chosen for their ruggedness, long lifetime, high efficiency, low voltage requirements, and the possibility to control the color and intensity of the emitted light independently. LEDs provide an improvement over delicate gas discharge lamp, incandescent bulb, and fluorescent lighting systems. Solid state lighting sources, such as LEDs, have the capability to create the same lighting impressions, but outweigh the drawbacks associated with the other lighting technologies.

Prior art LED module systems have primarily been directed to string systems having limited interconnection flexibility. The modules or housings containing the LED's in these systems have often been inflexible with respect to modification. It would be desirable to develop a lighting technology that would be flexible in application by building a lighting system with simple modifiable modular elements having flexible interconnectivity.

Thus, an objective of the present invention is to provide an LED module and interconnection system that can be easily installed in various applications, including outdoor applications, and is flexible in the method of interconnection and arrangement of the LED's.

SUMMARY OF THE INVENTION

An LED module is disclosed that includes a housing, a printed circuit board disposed within the housing, the printed circuit board comprising connector sections having electrical contacts that provide electrical connectivity to electrical components supported by the printed circuit board, and a lens attached to the housing. The housing includes an opening for receiving a connector for providing electrical connectivity to the printed circuit board, and the electrical components include at least one LED.

The LED module further includes a gasket disposed between the lens and the housing. The LED module may further include an attachment film for attaching the LED module to a support surface.

The LED module housing includes a PCB support and alignment post for attaching the PCB within the housing in a predetermined orientation. The LED module housing may have four openings for receiving a connector for providing electrical connectivity to the printed circuit board. The LED module housing includes an opening housing generally surrounding the opening, and the opening housing is configured to receive a connector in only one predetermined orientation. The opening housing comprises tabs for releasably engaging the connector.

An LED module and interconnection system is also disclosed that includes an LED module and a cable assembly. The LED module includes a housing, a printed circuit board disposed within the housing, the printed circuit board comprising connector sections having electrical contacts that provide electrical connectivity to electrical components supported by the printed circuit board, and a lens attached to the housing.

The housing includes an opening for receiving a connector for providing electrical connectivity to the printed circuit board. The housing may include one, four or more openings. The electrical components include at least one LED.

The cable assembly includes a cable having two ends and a connector disposed at either end thereof. The connectors are configured to be received in an opening of the housing and engage the connector portion of the printed circuit board to form an electrical connection with electrical contacts of the printed circuit board. The cable assembly may include a connector disposed at both ends of the cable.

The system further includes a gasket disposed between the lens and the housing. The system may further include an attachment film for attaching the LED module to a support surface.

The LED housing of the system includes a PCB support and alignment post for attaching the PCB within the housing in a predetermined orientation. The LED housing may have four openings for receiving a connector for providing electrical connectivity to the printed circuit board. The housing further includes an opening housing generally surrounding the opening, the opening housing configured to receive the cable assembly in only one predetermined orientation.

The opening housing includes tabs for releasably engaging the cable assembly. The opening and cable assembly are configured so the cable assembly can be received in the opening in only one predetermined orientation. The connectors include resilient latches configured to releasably engage tabs on an opening housing generally surrounding the opening.

The connectors further include a housing insertion section comprising spring contacts configured to form an electrical connection with the electrical contacts of the printed circuit board when the connector is received in the opening of the housing. The housing insertion section further includes sealing features configured to environmentally seal the opening when the insertion section is inserted.

The system may further include a module plug configured to environmentally seal an opening of the housing. The module plug may be made from a soft polymer such as a thermoplastic elostomer.

Further aspects of the method and system are disclosed herein. The features as discussed above, as well as other features and advantages of the present invention will be appreciated and understood by those skilled in the art from the following detailed description and drawings.

DETAILED DESCRIPTION OF THE INVENTION

The present invention now will be described more fully hereinafter with reference to the accompanying drawings, in which a preferred embodiment of the invention is shown. This invention may, however, be embodied in many different forms and should not be construed as limited to the embodiments set forth herein; rather, these embodiments are provided so that this disclosure will be thorough and complete and will fully convey the scope of the invention to those skilled in the art.

Figure 1:
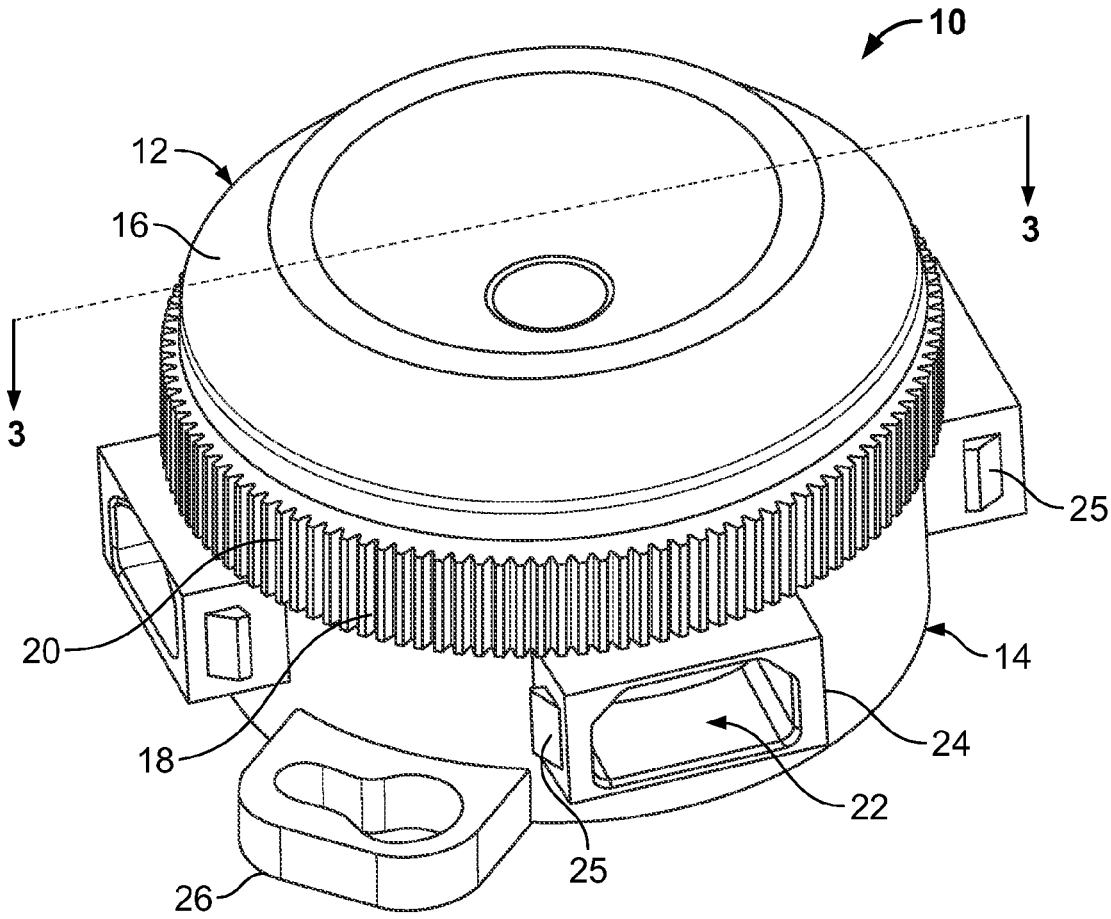
FIG. 1 illustrates a perspective view of an exemplary embodiment of an LED module of the present invention.

With reference to FIG. 1, an exemplary embodiment of a light emitting diode (LED) module 10 having a lens 12 and housing 14 is disclosed. Lens 12 includes a top surface portion 16 and a rearward portion 18. Top surface portion 16 may have any practical geometry as known in the art to project and/or diffuse light. Rearward portion 18 has serrations 20 to assist in attaching the lens 12 to the housing 14. Alternatively, rearward portion 18 may have other grip assisting features or tool slots, such as corners and sides, or may be a smooth cylindrical surface. Lens 12 may be formed of any lens material known in the art, including, but not limited to glasses and plastics.

As shown in FIG. 1, the housing 14 has a generally circular cross section, however, other cross sectional geometries including square, hexagonal, triangular, octagonal or other polygon, as well as curved profiles may be used for applications having different assembled system geometries. Housing 14 includes a plurality of openings 22, opening housings 24, and attachment points 26. In this exemplary embodiment, the housing 14 is shown with four openings, although in alternative embodiments, one, two, three or more than four openings may be present. Opening housings 24 generally surround openings 22. Opening housings 24 include tabs 25. Openings 22 and opening housings 24 are shown having a generally rectangular geometry, but other alternative geometries including square, triangular, round and combinations thereof may be used for either or both the access openings 22 and opening housings 24. Attachment points 26 are configured to secure the housing 14 to a support surface (not shown). The attachment points 26 may be omitted in applications where the module 10 is intended to stand freely or when the module 10 is affixed by an external element. Housing 14 is preferably formed of a plastic housing material, but may be formed of any housing material known in the art.

Figure 2:
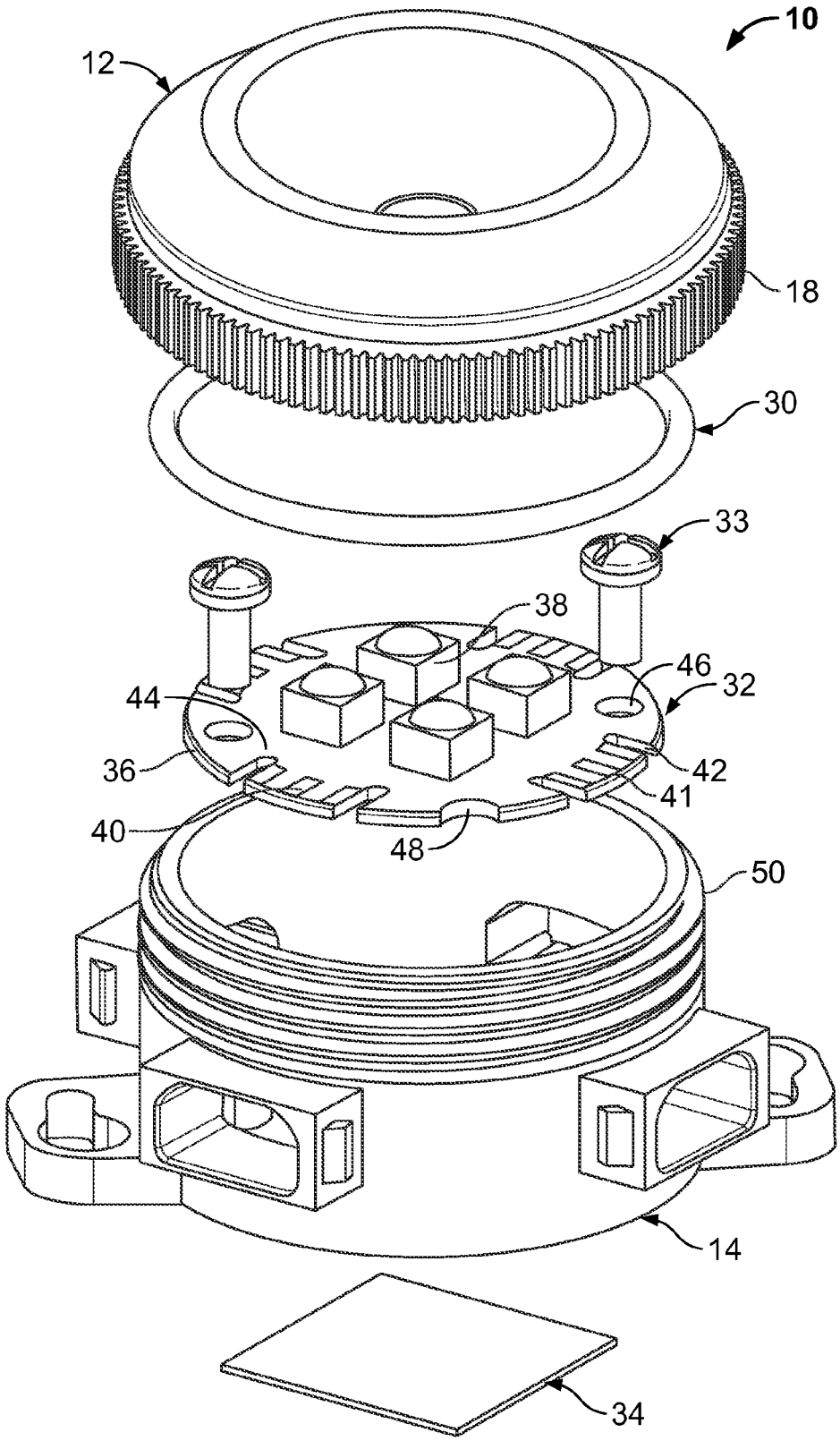
FIG. 2 illustrates an exploded view of the LED module of FIG. 1.

An exploded view of LED module 10 is shown in FIG. 2. As can be seen in FIG. 2, the LED module 10 further includes a gasket 30, a populated printed circuit board (PCB) assembly 32, fasteners 33 such as screws, and an attachment film 34. The gasket 30 may be a flat gasket, an O-ring gasket, or other similar gasket configured to form an environment seal between the lens 12 and the housing 14. The PCB assembly 32 includes a substantially circular PCB 36 supporting LEDs 38. The LEDs 38 may be attached to the PCB 36 by surface mount soldering or through hole soldering. Although the PCB assembly 32 is shown including four LEDs, the number of LEDs supported by the PCB assembly 32 may vary.

The PCB 36 includes connector sections 41. The connector sections 41 are disposed between connector slots 42 as shown in FIG. 2. The connector sections 41 include contact pads 40. The contact pads 40 are conductively connected by traces (not shown) to the LEDs 38 and/or to any additional electrical components (not shown), such as resistors and capacitors, supported on the PCB 36. Thus, the contact pads 40 are configured to provide electrical connectivity to the LEDs 38 and/or any additional electrical components (not shown). The contact pads 40, traces (not shown), and any additional electrical components (not shown) may be mounted on a top surface 44 of the PCB 36, a bottom surface (not shown), or both. Although the PCB 36 is shown having contact pads 40 located on four connector sections 41, contact pads 40 may be omitted from some of the connector sections 41 as required by design.

The PCB 36 additionally includes holes 46 and an alignment notch 48. Holes 46 allow fasteners 33 to releasably attach the PCB 36 within the housing 14, and the alignment notch 48 assures a predetermined orientation of the PCB 36 when attached within the housing 14. Although the PCB 36 is shown with two holes 46 and one alignment notch 48, the PCB 36 may be provided with any number of screw holes 46 and alignment notches 48 to facilitate installing and securing the PCB 36 to the housing 14.

Attachment film 34 may be a two-sided adhesive tape or other similar adhesive, which is intended to attach a bottom surface (not shown) of the housing 14 to a support surface (not shown). The attachment points 26 may be omitted when the attachment film is used to attach the housing 14 to a support surface (not shown). Alternatively, attachment film 34 may be omitted and the housing attached by the attachment points 26, or both the attachment points and the attachment film may be omitted.

As can further be seen in FIG. 2, the housing 14 includes external threads 50 configured to engage internal threads (not shown) on an internal surface (not shown) on the rearward portion 18 of lens 12.

Figure 3:
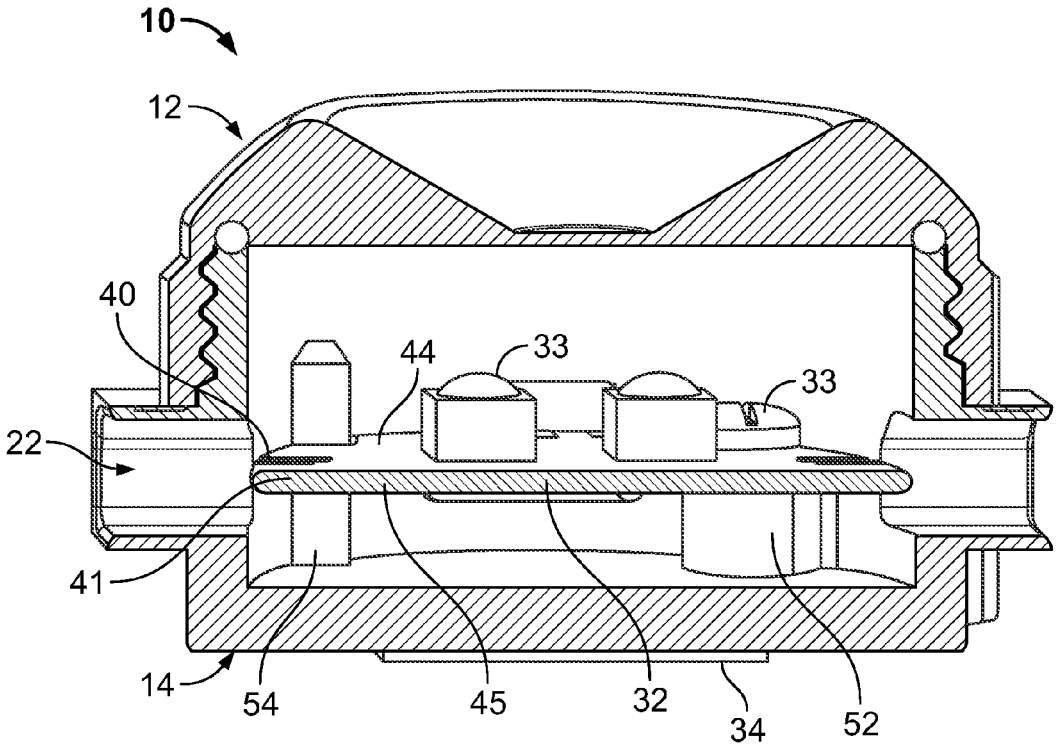
FIG. 3 illustrates a cross-sectional view of the LED module of FIG. 1 taken along line 3-3 of FIG. 1.

A cross-sectional view of the LED module 10 of FIG. 1 taken along line 3-3 is shown in FIG. 3. As can be seen in FIG. 3, the housing 14 further includes PCB supports 52 for supporting the PCB 32 in the housing 14. PCB supports 52 have internal channel (not shown) for receiving fasteners 33 in attaching the PCB 32 to the housing 14. In this exemplary embodiment, the housing 14 includes two PCB supports 52, one positioned on each side of the cross-section, positioned to correspondingly receive the fasteners 33 as shown in FIG. 2. The housing 14 further includes alignment post 54 configured to be received in alignment notch 48 (FIG. 2). Alternatively, the housing 14 may include more than one alignment post 54 and corresponding alignment notch 48 (FIG. 2). As can be further seen in FIG. 3, the openings 22 provide access to the PCB connector sections 41.

Figure 4:
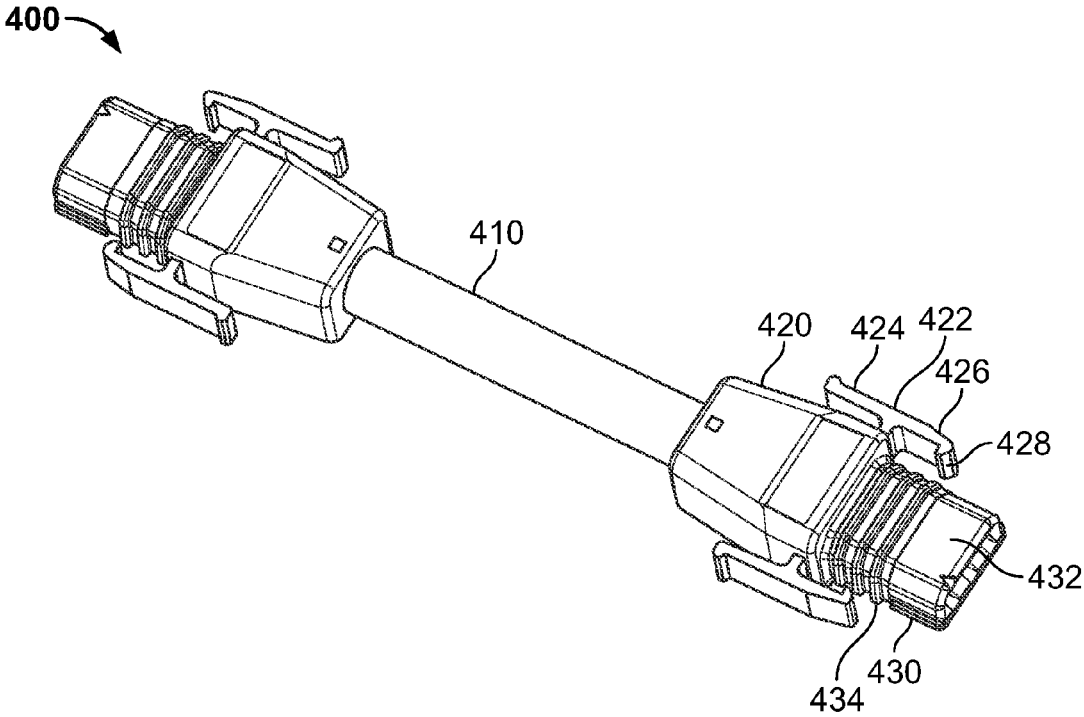
FIG. 4 illustrates a perspective view of an exemplary embodiment of a flexible connector of the present invention.

FIG. 4 illustrates an exemplary cable assembly 400 used to physically and electrically connect two LED modules 10 (FIG. 1) together or an LED module 10 (FIG. 1) to another electrical component (not shown). The electrical component may be a power supply, power source, LED driver or other lighting component. Cable assembly 400 includes a cable 410 and two connectors 420 disposed at opposite ends of the cable 410. The cable 410 includes conductors or wires (not shown). The cable length may vary depending upon application, as would be appreciated by one of ordinary skill in the art. The wires (not shown) are terminated by terminals or contacts (not shown) in the connectors 420. The wires (not shown) may be terminated to the contacts (not shown) by soldering, crimping, resistance welding, ultra sonic welding or any other similar termination method. The contacts (not shown) may be spring contacts 510 (see FIG. 6).

As shown in FIG. 4, the connectors 420 include resilient latches 422. The connectors 420 are shown having two resilient latches 422, however, the number and configuration of resilient latches 422 on a single connector 420 may vary, and should be configured to mate to corresponding tabs 25 (FIG. 1) of housing 14 (FIG. 1). For example, in alternative embodiments, each connector 420 may include one, three, four or more resilient latches 422. Furthermore, in an alternative embodiment, the cable assembly 400 may include only one connector 420, with the opposite end of the cable 410 having wires, contacts, or similar electrical interconnection for terminating the cable assembly 400 to another electrical device.

Resilient latches 422 include a tab section 424 and a latching section 426. The resilient latches 422 are configured to pivot to allow the latching section 426 outward movement when the connector 420 is inserted into an opening 22 in housing 14 so as to engage a corresponding tab 25 (FIG. 1) on housing 14 (FIG. 1). The latching section 426 includes an inward protrusion 428. Inward pressure applied to the tab section 424 pivots the latching section 426 outward, releasing the resilient latches 422 once engaged to a corresponding tab 25 (FIG. 1).

The connectors 420 further include a housing insertion section 430. The housing insertion section 430 includes an outer surface 432 including sealing features 434. Sealing features 434 extend circumferentially around the outer surface 432 as shown in FIG. 4, however, it should be appreciated that alternative configurations of sealing features may be used to provide environmental protection. In alternative embodiments, the sealing features may be deleted. The housing insertion section 430 has a generally rectangular geometry that substantial corresponds with the openings 22 in the module housing 14 (FIG. 1). The housing insertion section 430, including ridges 434, may be formed of a soft polymer or compliant polymeric material, such as thermoplastic elastomer. For example, the thermoplastic elastomer may be Santoprene™ made by ExxonMobile Chemical Company of Houston, Tex.

Figure 5:
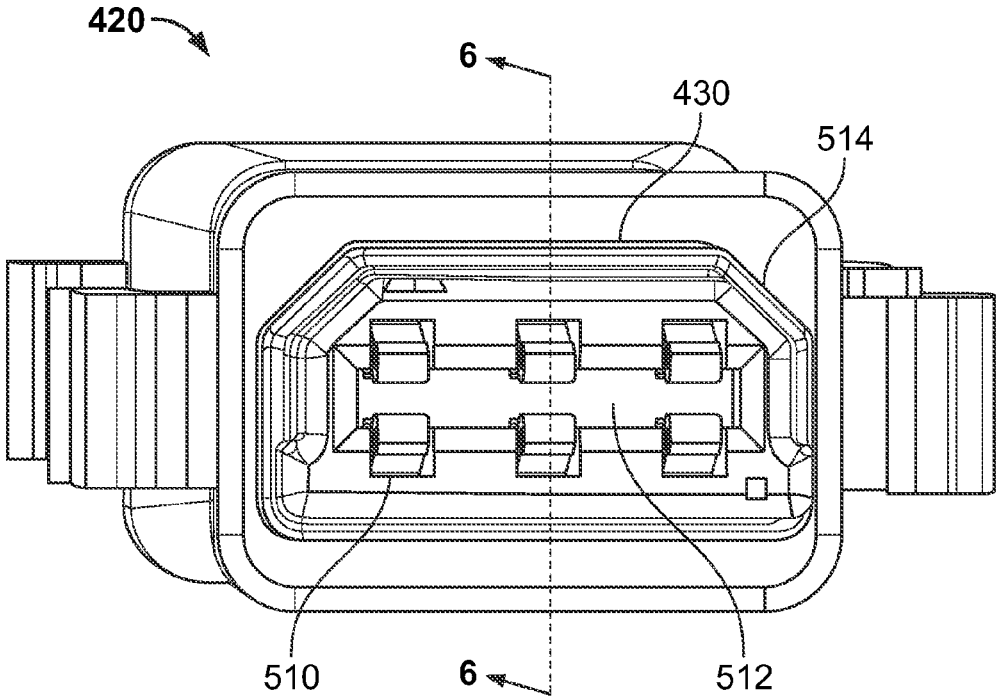
FIG. 5 illustrates an end view of an exemplary connector of the present invention.

An end view of connector 420 is shown in FIG. 5. As can be seen in FIG. 5, the connector 420 further includes spring contacts 510 supported on a contact support 512. As can also be seen in FIG. 5, the housing insertion section 430 includes chamfered sides 514 that assist in aligning the connector 420 with a corresponding opening 22 (FIG. 1) and to assure that the connector 420 is inserted in an opening 22 with the correct orientation. In alternative embodiments, other contacts may be used in place of the spring contacts 510 to form the electrical connection between the cable assembly 400 (FIG. 4) and the LED module 10 (FIG. 1).

Figure 6:
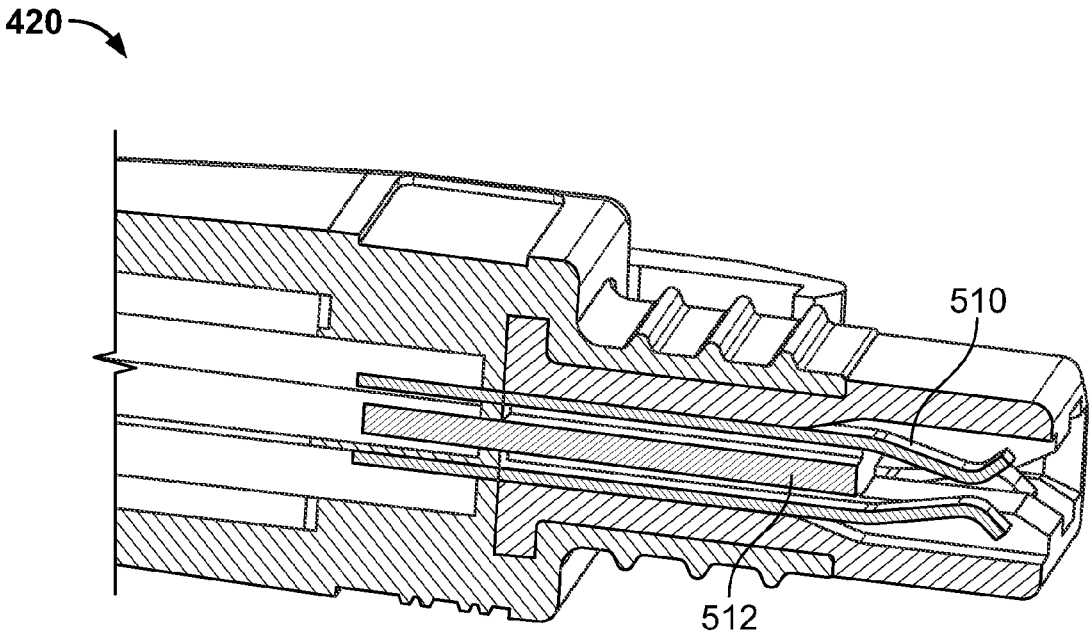
FIG. 6 illustrates a partial cross-sectional view of the connector of FIG. 5 taken along line 6-6 of FIG. 5.

A partial cross-sectional view of connector 420 taken along line 6-6 of FIG. 5 is shown in FIG. 6. As can be seen in FIG. 6, spring contacts 510 are configured within the housing insertion section 430 such that when the housing insertion section 430 is inserted into an opening 22 (FIG. 3) of the housing 14 (FIG. 3), spring contacts 510 receive the connector portion 41 (FIG. 3) of the PCB 32 (FIG. 3) and form an electrical connection with corresponding contacts 40 (FIG. 3), thereby providing an electrical connection to the LED module 10 (FIG. 3).

Figure 7:
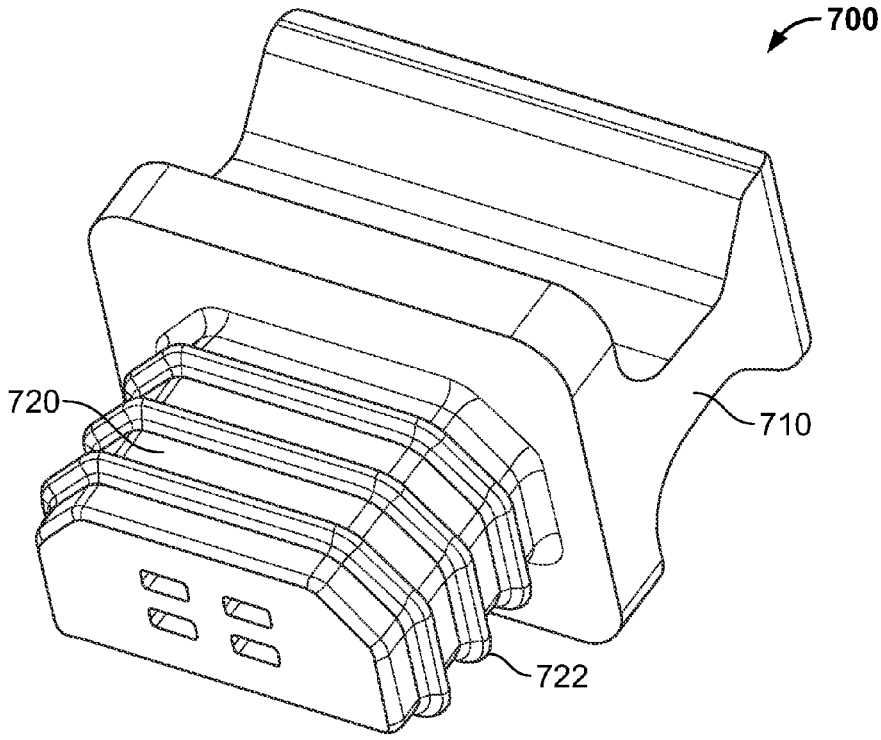
FIG. 7 illustrates a perspective view of an exemplary opening plug of the present invention.

FIG. 7 shows an optional module plug 700. Module plug 700 includes a handle portion 710 and an insertion portion 720. The insertion portion 720 includes sealing features 722 disposed around the circumference of the insertion portion 720. The insertion portion 720 has a generally rectangular geometry that substantial corresponds with the openings 22 in the module housing 14 (FIG. 1). The insertion portion 720, including sealing features 722 are formed of a soft polymer or compliant polymeric material, such as a thermoplastic elastomer. The elastomer may be Santoprene™ made by ExxonMobile Chemical Company of Houston, Tex.

Figure 8:
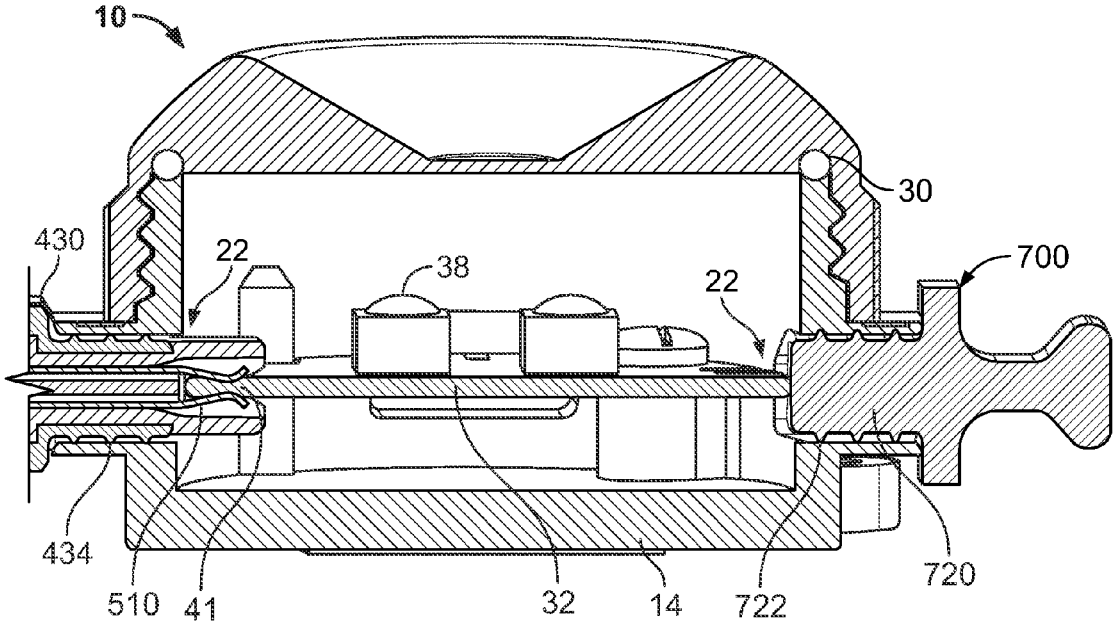
FIG. 8 illustrates a cross-sectional view of the LED module of FIG. 1 taken along line 3-3 of FIG. 1 having a connector and an opening plug inserted.

FIG. 8 shows a cross-sectional view taken along line 3-3 of FIG. 1 with a partial section of a housing insertion section 430 and a module plug 700 shown inserted into openings 22. As shown in FIG. 8, spring contacts 510 are engaging contact pads 40 (FIG. 3) on connector sections 41 of PCB 32 to provide electrical connection to LEDs 38 and other electrical components supported on the PCB 32, and LED module opening plug 700 substantially seals closed corresponding opening 22. The ridges 434 of the housing insertion section 430 and the sealing features 722 of the module plug 700 are configured to form an environmental seal with the housing 14. As can be further seen in FIG. 8, gasket 30 forms an environmental seal between housing 14 and lens 12.

Figure 9:
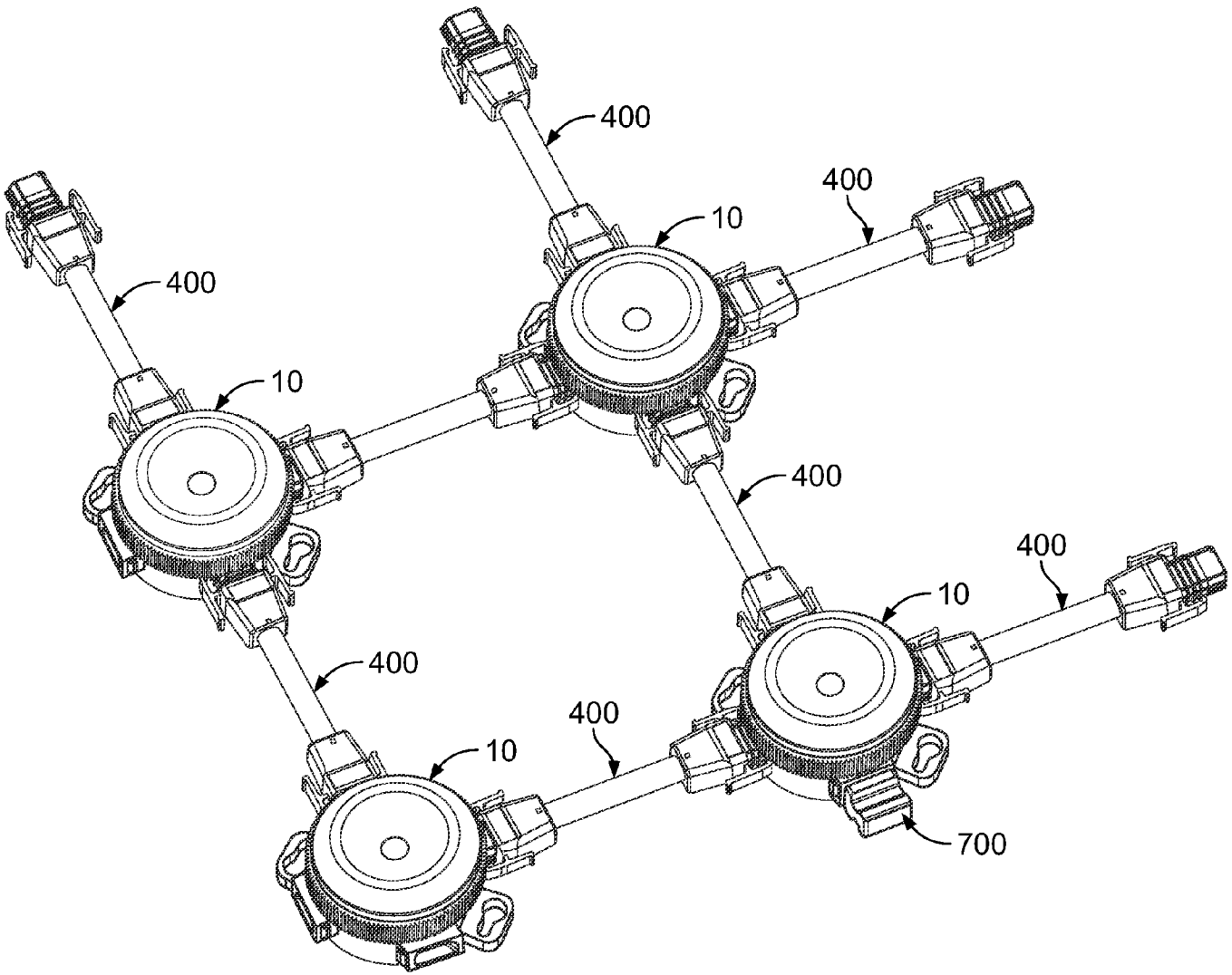
FIG. 9 illustrates an exemplary configuration of the LED module and interconnection system of the present invention.

An exemplary arrangement of LED modules 10 and wire connectors 400 is shown in FIG. 9. As can be seen in FIG. 9, a module plug 700 has been used to seal one of the LED modules 10 and prevent further connectivity. As can be seen in FIG. 9, the design of the LED module 10 and cable assembly 400 permits a wide variety of lighting design configurations to be assembled.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An LED module, comprising:

a housing;

a printed circuit board disposed within the housing, the printed circuit board comprising electrical components and connector sections, the connector sections including contact pads and electrical contacts configured to provide electrical connectivity to the electrical components supported by the printed circuit board, the contact pads mounted on a surface of the printed circuit board; and a lens attached to the housing;

wherein the housing comprises a plurality of openings for receiving a housing insertion section of a connector allowing contacts of the connector to physically and electrically engage the contact pads on printed circuit board for providing physical and electrical connectivity directly between the contacts of the connector and the contact pads on the surface of the printed circuit board; and wherein the electrical components comprise at least one LED.

2. The LED module of claim 1, further comprising a gasket disposed between the lens and the housing.

3. The LED module of claim 1, further comprising an attachment film for attaching the LED module to a support surface.

4. The LED module of claim 1, wherein the housing comprises a PCB support and alignment post for attaching the PCB within the housing in a predetermined orientation.

5. The LED module of claim 1, wherein the plurality of openings is four openings.

6. The LED module of claim 1, wherein the housing further comprises an opening housing generally surrounding the opening, the opening housing configured to receive a connector in only one predetermined orientation.

7. The LED module of claim 6, wherein the opening housing comprises tabs for releasably engaging the connector.

8. An LED module and interconnection system, comprising:

an LED module comprising:

a housing;

a printed circuit board disposed within the housing, the printed circuit board comprising electrical components and connector sections, the connector sections including contact pads and electrical contacts configured to provide electrical connectivity to the electrical components, the contact pads mounted on a surface of the printed circuit board; and a lens attached to the housing:

wherein the housing comprises a plurality of openings for receiving a housing insertion section of a connector of a cable assembly for allowing contacts of the connector to physically and electrically engage the contact pads on the printed circuit board for providing physical and electrical connectivity directly between the contacts of the connector and the contact pads on the surface of the printed circuit board; and wherein the electrical components include at least one LED; and the cable assembly comprising a cable having two ends and respective connectors disposed at either end thereof, each of the connectors configured to be received in an opening of the plurality of openings and engage the contact pads of the printed circuit board and form an electrical and physical connection with the printed circuit board contact pads.

9. The system of claim 8, wherein the cable assembly comprises two connectors disposed at both ends of the cable.

10. The system of claim 8, further comprising a gasket disposed between the lens and the housing.

11. The system of claim 8, further comprising an attachment film for attaching the LED module to a support surface.

12. The system of claim 8, wherein the housing comprises a PCB support and alignment post for attaching the PCB within the housing in a predetermined orientation.

13. The system of claim 8, wherein the housing has four openings for receiving a connector for providing electrical connectivity to the printed circuit board.

14. The system of claim 8, wherein the housing further comprises an opening housing generally surrounding the opening, the opening housing configured to receive the flexible connector in only one predetermined orientation.

15. The system of claim 8, wherein the opening housing comprises tabs for releasably engaging the cable assembly.

16. The system of claim 8, wherein the connectors include a compliant latch configured to releasably engage tabs on an opening housing generally surrounding the opening.

17. The system of claim 8, further comprising a module plug configured to environmentally seal an opening of the housing.

18. The system of claim 8, wherein the connectors comprise a housing insertion section comprising contacts configured to form an electrical connection with the electrical contacts of the printed circuit board when the connector is received in the opening of the housing.

19. The system of claim 8, wherein the housing insertion section further comprises ridges configured to environmentally seal the opening when the insertion section is inserted.

20. The system of claim 8, wherein the plurality of openings is four openings.

* * * * *